US009381549B1

(12) United States Patent
Kane et al.

(10) Patent No.: US 9,381,549 B1
(45) Date of Patent: Jul. 5, 2016

(54) PORTABLE DESCALING MACHINE FOR HEAT TRANSFER SYSTEMS

(75) Inventors: Timothy Kane, Greenwich, CT (US); George M Cruz, Norwalk, CT (US)

(73) Assignee: Crossford International, LLC, Stamford, CT (US)

( * ) Notice: Subject to any disclaimer, the term of this patent is extended or adjusted under 35 U.S.C. 154(b) by 1055 days.

(21) Appl. No.: 13/317,085

(22) Filed: Oct. 7, 2011

(51) Int. Cl.
*B08B 9/032* (2006.01)

(52) U.S. Cl.
CPC ..... *B08B 9/0321* (2013.01)

(58) Field of Classification Search
CPC ..... B08B 9/0321; B08B 3/04; B08B 9/032; B08B 9/0856; B08B 9/093
USPC ..... 134/22.1, 198, 34, 10, 166 R, 184
See application file for complete search history.

(56) References Cited

U.S. PATENT DOCUMENTS 3,667,488 A * 6/1972 Paggen ..... 134/169 A
7,513,444 B1 * 4/2009 Kurimski et al. ..... 239/332
2012/0118246 A1 * 5/2012 Oberkorn et al. ..... 122/382

FOREIGN PATENT DOCUMENTS

WO WO 2007063452 A2 * 6/2007 ..... A47L 11/305

OTHER PUBLICATIONS blog.speedclean.com_February_2011.pdf , web page posted on blog.speedclean.com in Feb. 2011.*
BucketDescaler_March_2011.pdf , web page posted on www.speedclean.com?BucketDescaler/default.aspx in Mar. 2011.*

* cited by examiner

*Primary Examiner* — David Cormier
*Assistant Examiner* — Irina Graf
(74) *Attorney, Agent, or Firm* — Patrick J. Walsh

(57) ABSTRACT

A system for descaling heat exchanger surfaces using an acidic solution, the system comprising a portable machine of container and cover with operating components including motor driven circulating pump, hose fittings, directional valve, fluid openings, housing and hatch mounted on reinforced cover.

4 Claims, 6 Drawing Sheets

PORTABLE DESCALING MACHINE FOR HEAT TRANSFER SYSTEMS

BACKGROUND OF THE INVENTION

This invention relates to and solves the problem of buildup of scale and hard water deposits on heat transfer surfaces of heat exchange equipment.

In heat exchangers in which water is used as a heat transfer medium, materials dissolved in the water including metal oxides, inorganic salts, calcium and mineral deposits form scale deposits on the inside surfaces of the tubes. These scale deposits can seriously reduce the efficiency of heat exchange equipment, can lead to higher operating costs and expensive repairs or even replacement of entire units, and must be removed from heat exchange surfaces so that the heat exchanger can operate at design efficiency.

There is advantage in a system for removing scale and mineral deposits from heat exchangers using a descaling solution of particular strength and maintaining selected strength for duration of descaling operation. Such a system provides efficient descaling with minimum downtime while restoring a heat exchanger to design thermodynamic efficiency.

The present invention has for its chief objective a system for descaling heat exchanger using a chemical solution for improved economic and thermodynamic operating efficiency.

SUMMARY OF THE INVENTION

The present invention provides a system for descaling heat transfer systems such as tankless water heaters. The invention circulates an acid based descaling solution to remove scale and mineral deposits to keep water heating equipment in optimal operating condition. Regular descaling reduces energy costs by keeping equipment clean, and cures circulation and boiler noise problems caused by the accumulation of sludge, corrosion deposits, and scale.

In accordance with the invention, a portable descaling system for heat transfer systems comprises a covered container of portable capacity with system operating components installed on the container cover. The cover is secured to the container, and fluid lines are connected from the cover to a heat transfer system. A descaling chemical added to the container is circulated through internal piping of heat transfer system for removal of scale, corrosion deposits and sludge.

A preferred embodiment of the invention utilizes a generally available standard size container such as a five-gallon bucket. A cover for the container is modified for mounting operating components that circulate a descaling solution through a heat exchanger. The container with modified cover is portable and readily carried into position for tankless water heater descaling.

A motor driven circulating pump is mounted within a protective housing atop the cover for delivering descaling solution through the water side of a water heater. A two-way valve preferably mounted on the underside of the cover with valve control accessible on top of the cover directs flow of descaling solution for filling the container with descaling solution, and for circulating solution through a water heater. In addition, a fill opening through the cover is provided for adding descaling solution directly to the container from a supply bottle.

For descaling a water heater, suitable hose connections attach the cover pump head to the heater establishing flow through outlet and return paths between container and water heater. Descaling solution is added to the container by either direct pour through an opening in the cover, or by siphon to the suction side of the pump through a two-way selection valve. The selection valve has a second inlet to the pump for drawing solution poured into the container. The selection valve is set according to source of descaling solution, i.e., siphon from supply bottle of descaling solution or solution from the container.

With connections made, descaling solution is circulated through a water heater for cleaning its water side. During cleaning, solution pH is monitored and kept at or below pH 5.5 by adding solution to the container. When pH of solution does not rise, descaling is complete. Solution is then neutralized and discarded. After descaling is completed, clean water is flushed through the heat exchanger for thoroughly rinsing chemical from the water side.

Specific examples are included in the following description for purposes of clarity, but various details can be changed within the scope of the present invention.

OBJECTS OF THE INVENTION

An object of the invention is to provide a descaling system for closed heat exchangers.

Another object of the invention is to provide a self-contained portable machine for removing scale and mineral deposits from heat exchange surfaces of closed vessels.

Another object of the invention is to provide a system for circulating a descaling solution of selected strength for cleaning heat exchanger surfaces, and for monitoring and maintaining selected strength of solution until descaling is complete.

Another object of the invention is to provide a descaling machine using a descaling solution and utilizing pH value of circulating solution in comparison to a known pH value for monitoring progress of descaling operation.

Another object of the invention is to provide for cleaning heat exchange surfaces of scale and mineral deposits with a solution of an acidic chemical under safe and efficient conditions.

Another object of the invention is to provide a portable descaling machine assembled in a standard size container for circulating acidic solution through tankless water heaters.

Another object of the invention is to provide a portable descaling machine assembled in a standard size covered container in which all operating components are mounted on the cover and the container receptacle serves as a reservoir for acidic solution for descaling a heat exchanger, and for a purging fluid after descaling is completed.

Other and further objects of the invention will become apparent with an understanding of the following detailed description of the invention or upon employment of the invention.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

The present invention provides a portable descaling machine particularly suited to descaling interior, pipe surfaces of the water side of tankless water heaters by pumping a descaling solution through the pipes, collecting and discarding spent solution, and pumping clean water through the pipes for purging any residue of descaling solution remaining in the pipes.

Figure 1:
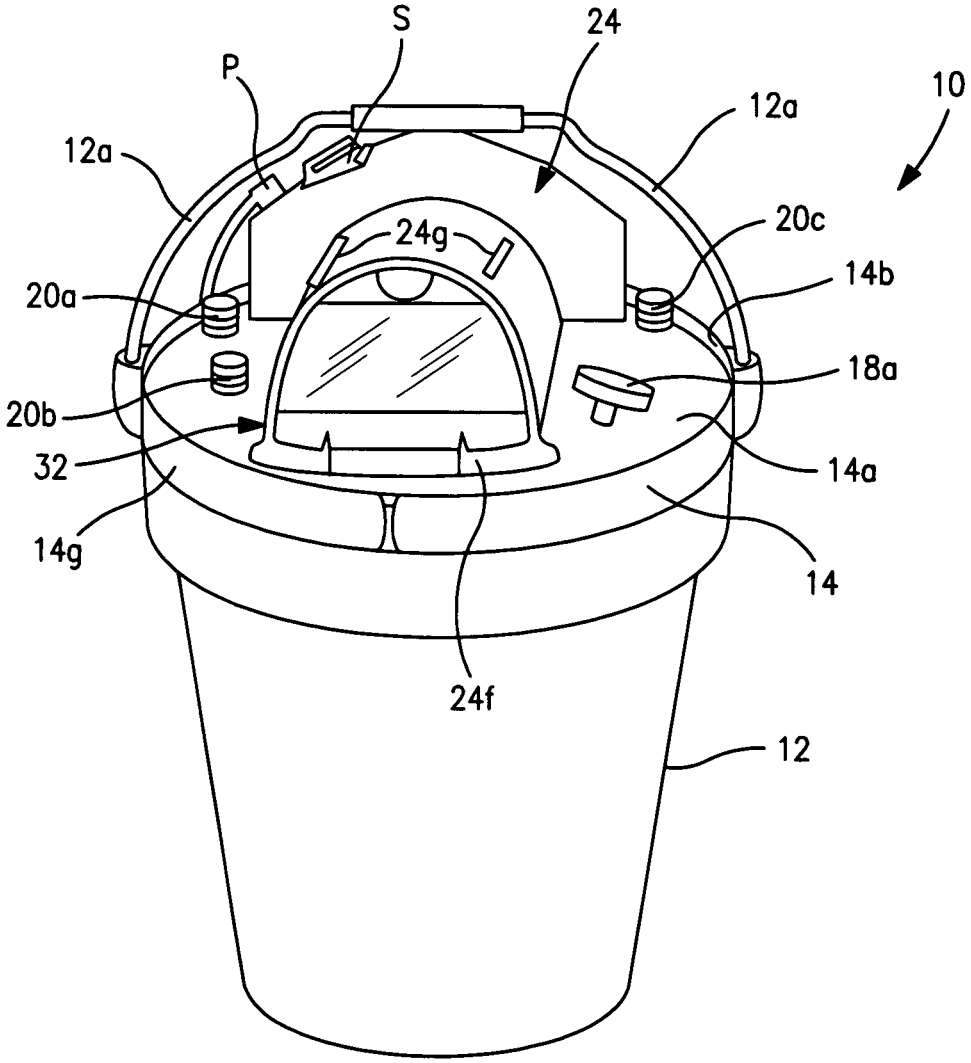
FIG. 1 is a perspective view of portable descaling machine for heat transfer systems according to the invention.

Referring to FIG. 1 of the drawing, the invention is directed to portable descaling machine for heat transfer systems including descaling machine 10' comprising main container or receptacle 12 and cover 14 for the container. The cover mounts solution circulating components comprising motor-pump 16 (FIG. 2), two-way valve 18 (FIGS. 5, 6), and hose connections 20*a-c*. Openings through the cover (FIG. 5) provide for pouring solution into the container (opening 22), hose connections 20*a-c* for pumping solution into a heat transfer system, for return of pumped solution to the main container, and for siphoning fresh solution from a supply bottle to the main container. Cover housing 24 encloses the motor-pump, positions power line connection P and on-off switch S for the motor-pump, and defines a pouring hatch 32 for directing fresh solution poured into the main container.

The main container 12 comprises a standard size vessel in wide commercial use and preferably is a five-gallon bucket suitable for ease and safety of being carried to any location for tankless water heaters. A bail 12*a* is pivotally connected to opposite sides of the main container and defines a balance or pivot axis for slight roll movement of the container.

The cover 14 has nominal dimensions for top panel 14*a* and peripheral rim 14*b*, and, on its underside (FIG. 5), has groove 14*c* and sealing gasket 14*d* for engagement (FIG. 3) with rim of main container 12*b*. The gasket subdues vibrational noise resulting from placement and operation of a rotating machine on a five-gallon bucket cover.

Figure 4:
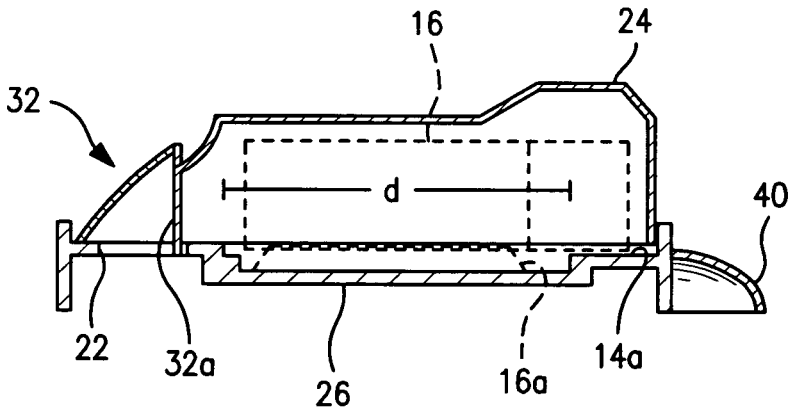
FIG. 4 is a section view of cover for machine taken along line 4-4 of FIG. 2.

Top panel 14*a* comprises the platform for mounting operating components of the machine. A reinforced oblong recess 26 in top panel lies generally along line 4-4 of FIG. 2 for mounting motor pump 16 on a support base 16*a* that is secured to the recess. The recess' long dimension d (FIG. 4) is normal to container balance axis (line 3-3, FIG. 2)' such that the mounted motor-pump lies across the balance axis for minimizing roll movement of machine when carried by its bail.

An opening 22 through panel 14*a* is provided for pouring chemical solution from a supply bottle into the main container. Standard size garden hose fittings pass through top panel sleeves 28 and define ports for connections that conduct pumped solution from the main container to a heat transfer system, return solution to container from heat transfer system H (FIG. 6), and siphon fresh chemical solution from supply bottle B to the suction side of circulating pump. Two-way flow valve 18 is positioned on the underside of the top panel with valve stem extending through the panel to a top side control knob 18*a* that selects one of siphoning flow to the pump from supply bottle and recirculating flow of descaling solution through the pump and heat exchanger.

Figure 3:
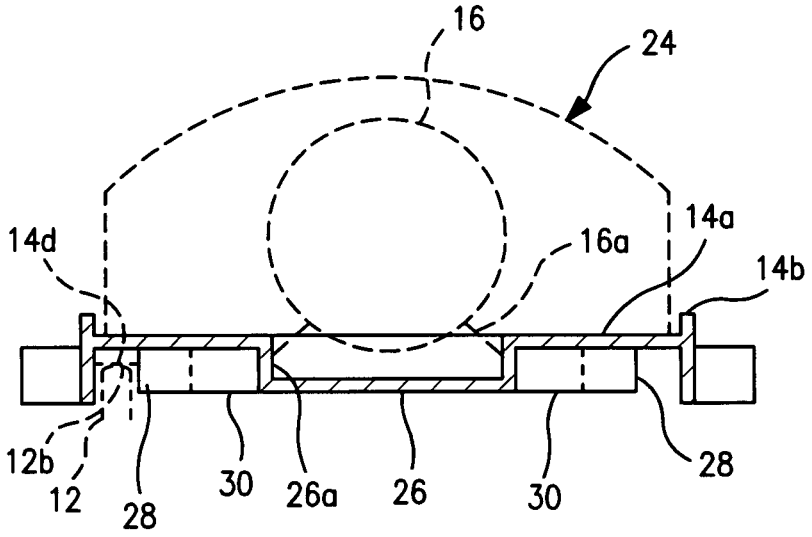
FIG. 3 is a section view of cover air machine taken along line 3-3 of FIG. 2.
Figure 5:
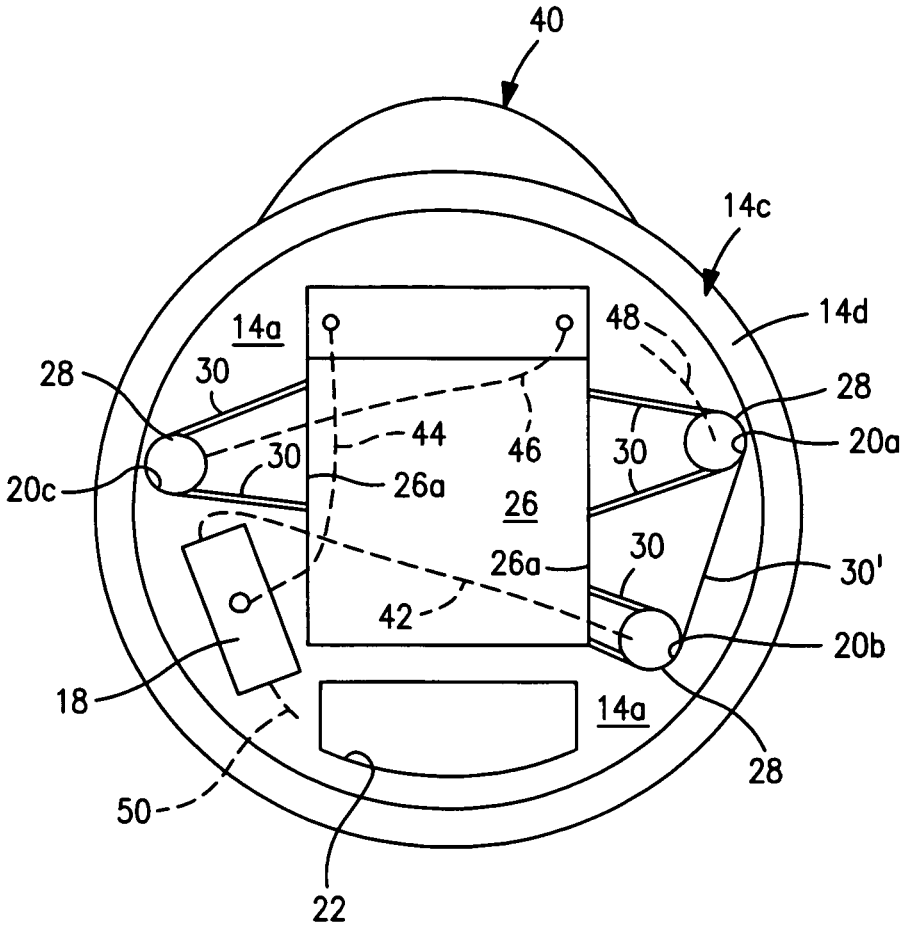
FIG. 5 is a plan view of the underside of the cover for the machine of FIG. 1.

As shown in FIGS. 3 and 5, the underside of top panel is reinforced by vertical ribs 30 each secured at one end to a top panel sleeve 28 and at its other end to motor pump recess wall 26*a*. A crossing rib 30' extends between sleeves located on the same side of recess 26. Ribs 30 and 30' have a height substantially the same as height of recess wall 26*a*. The result is a rigid top panel capable of handling and withstanding weight and operating vibration of motor pump as well as that of hoses and hose fittings with circulating solution.

The motor pump comprises a 1 ampere, 115 volt, ⅙ HP motor with diaphragm type pump of 3 GPM flow and maximum head of 69 feet.

T-shape housing 24 encloses the motor pump and defines a covered hatch 32 through which solution is poured into the main container through cover opening 22. The housing 24 comprises a shell 24*a* having a base line 24*b* (FIG. 2) in full perimeter engaging and secured to top panel surface with suitable fasteners. Housing cross head 24*c* encloses pump end of motor pump and has back base line edge 24*d* following contour of cover rim. Motor power line P and operating switch S are mounted on the housing cross head. Housing central portion 24*e* covers the remaining portion of the pump and terminates in covered pour hatch 32 located above panel opening 22 for pouring solution or clean water into the container. Vertical hatch wall separates 32*a* hatch from housing interior to guard motor pump from solution spillage. The housing provides a' ridge 24*f* extending along the margin of panel opening with hinge pintles for pivotally mounting a manually operable hatch cover 36. The cover is preferably of transparent plastic and has surface ribs 36*a* conforming to housing hatch margins 32*b*.

Housing vents 24*g* (FIG. 1) are formed in housing central portion to allow ambient air circulation around the enclosed motor.

Figure 2:
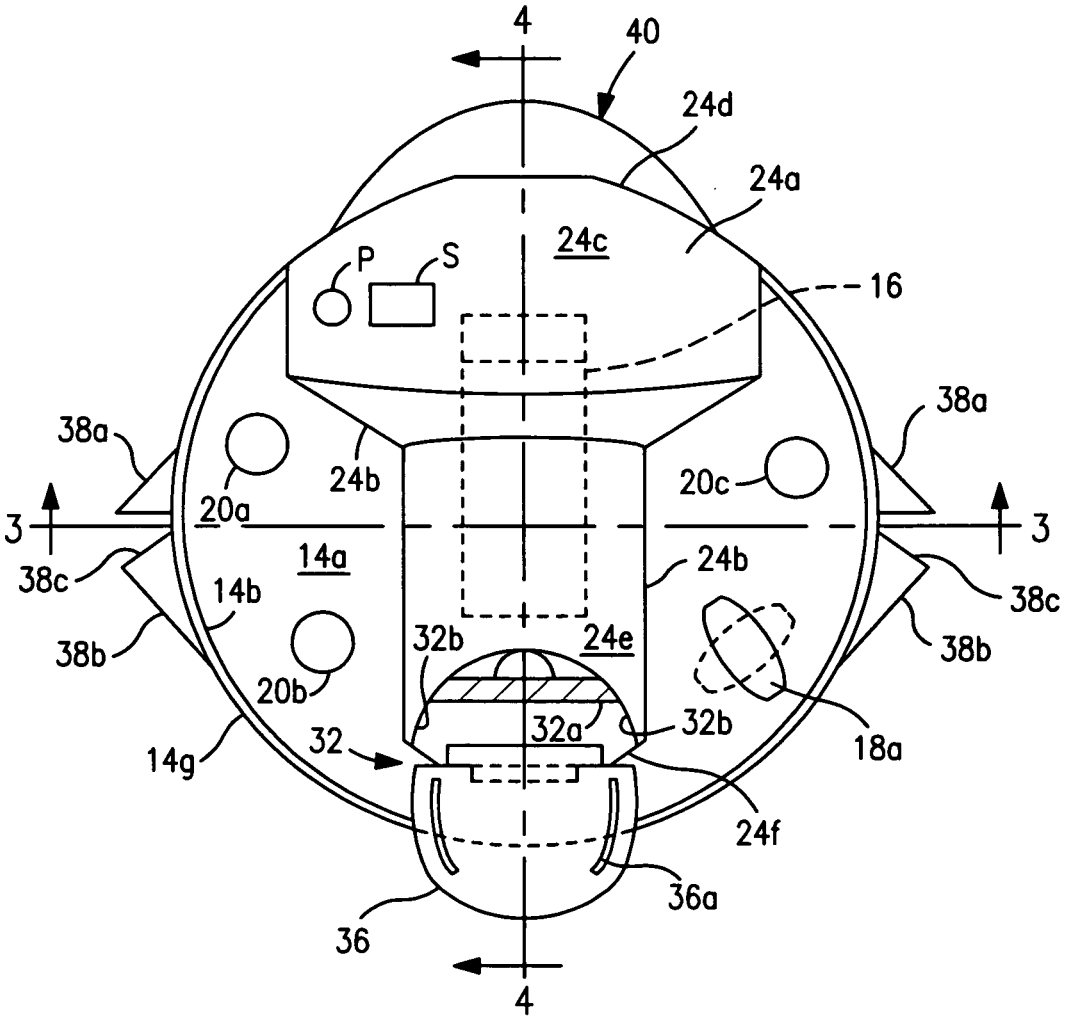
FIG. 2 is a plan view of the machine of FIG. 1.

As shown in FIG. 2, a pair of embossments 38*a*, 38*b* are fitted at diametrically opposed locations of the exterior surface of cover skirt 14*g*. The opposed locations are directly above the points at which the bail 12*a* attaches to the bucket. Each pair of embossments 38*a-b* define a notch or recess 38*c* for engaging and confining in vertical position the bail 16 provided for lifting the bucket. One of the embossments 38*b* is defined by inclined plane surfaces allowing the bail to move over the embossment into and out of the notch. The other of the embossments 38*a* has one plane surface nearly normal to the skirt for retaining the bail in the notch and an inclined plane past which the bail may also move for entering notch. This embossment and bail arrangement stabilizes the bucket from tipping or upsetting when picked up by its bail. Such tipping hazard is present when the container is empty resulting in a top heavy machine due the excess weight of motor-pump as compared to weight of empty container. A hand grip 40 is formed along the periphery of the cover behind the back end of cover housing and diametrically opposite pour hatch and defines an aid in removing the cover from the container.

Figure 6:
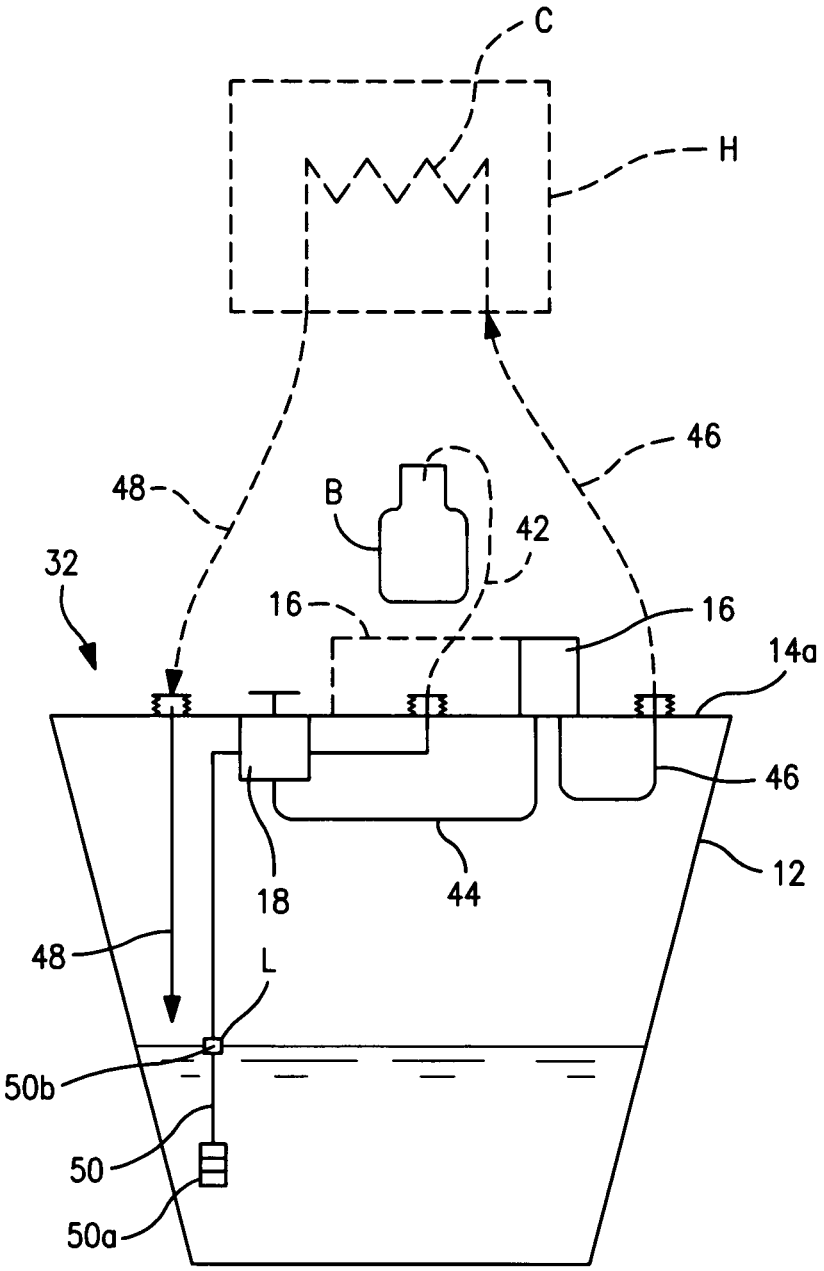
FIG. 6 is a schematic view of machine of FIG. 1 in position for descaling a heat exchanger.

In operation as shown in FIG. 6, descaling solution is added to the machine either by pouring into, the container through cover hatch 32 or by siphoning from supply bottle B through line 42 into two-way valve 18 and into the suction side of pump through line 44. Siphoned solution is pumped through line 46 into heat exchanger coil C and returned to container 12 through line 48. When solution is established to desired level in container designated by level marker on screened feed line, the two-way valve 18 is set for recirculation of solution from container through lines 50 and 44 to pump suction side, from pump through line 46 into through heat exchanger coil and return to container. Circulation of solution through coil provides coil descaling. Increase of solution pH value above 5.5 pH indicates that descaling solution needs to be added, for continued descaling. When pH does not rise above 5.5 pH, descaling is completed. Line 50 within the container has an entry filter 50*a* and level marker 50*b* indicating to the operator the correct solution level so that two-way valve can be, switched from "siphon fill" position to "recirculate position".

After descaling, spent solution is sealed in the existing container using a standard five-gallon bucket cover and discarded. The machine cover 14 is placed on another container of clean water that is recirculated through the heat exchanger to rid coil of solution residue.

In practicing the invention, the acidic solution is a mixture of water and phosphoric acid in a, 70 to 90% water-to-acid ratio, and is available under the SpeedyBright tradename.

Various changes may be made to the structure embodying the principles of the invention. The foregoing embodiments are set forth in an illustrative and not in a limiting sense. The scope of the invention is defined by the claims appended hereto.

I claim:

1. A portable receptacle and a cover for circulating a descaling solution through the coil of a heat exchanger and from the heat exchanger to the receptacle, the cover comprising a top panel and a peripheral rim, the underside of the top panel having a circumferential groove and a gasket adjacent the peripheral rim for mounting the cover on the receptacle, the receptacle having a bail pivotally connected to opposite sides of the receptacle defining a pivot axis, a reinforced oblong recess situated in the top panel, a motor pump, the motor pump having a support base positioned within the recess and there secured to the top panel, the recess in the top panel having a long dimension normal to the pivot axis, the recess defining walls on the underside of the top panel, and the motor pump positioned within the recess so that it is aligned with the long dimension and normal to the pivot axis to minimize roll as the receptacle and the cover are carried by the bail, the motor pump having inlet and outlet sides for circulating the solution, a two-way valve mounted on the cover with a valve outlet connection to the inlet side of the motor pump, the two-way valve further having a first valve inlet connection to siphon the solution from a supply source, and a second valve inlet connection to draw the solution from the receptacle, the two-way valve further having a valve control to select one of the first valve inlet connection and the second valve inlet connection for a solution flow, flow lines extending between each of the supply source and the first valve inlet connection, the receptacle and the second valve inlet connection, the valve outlet connection to the pump inlet side, the pump outlet side to a heater coil, the heater coil to the receptacle, the top panel having openings passing through sleeves to accommodate the flow lines between the supply source and the two-way valve, the pump outlet side to the heater coil, and the heater coil to the receptacle, the underside of the top panel being reinforced by vertically disposed ribs extending between the sleeves and the recess walls, the top panel having a pour opening for adding the solution to the receptacle, and a housing cover for the top panel enclosing the motor pump, and defining a hatch over the pour opening.

2. A receptacle and cover as defined in claim 1 in which the two-way valve is mounted on the underside of the top panel and the valve control is operable above the top panel.

3. A receptacle and cover as defined in claim 1 in which the cover has a skirt surface with notches for engaging and confining the bail in vertical position.

4. A receptacle and cover as defined in claim 1 in which the cover has a hand grip along the periphery of the cover diametrically opposite the pour opening.

* * * * *